US007387137B2

(12) United States Patent
Chung

(10) Patent No.: US 7,387,137 B2
(45) Date of Patent: Jun. 17, 2008

(54) ROTATING SPOUT LOCK JOINT SLEEVE

(76) Inventor: Chiu-Chih Chung, No. 31, Lane 275, Sec. 4, Lu Ho Rd., Lu Kan Chen, Chunghua Hsien (TW)

( * ) Notice: Subject to any disclaimer, the term of this patent is extended or adjusted under 35 U.S.C. 154(b) by 102 days.

(21) Appl. No.: 11/050,842

(22) Filed: Feb. 7, 2005

(65) Prior Publication Data

US 2006/0174953 A1 Aug. 10, 2006

(51) Int. Cl.
*E03C 1/04* (2006.01)

(52) U.S. Cl. ..... 137/615; 137/801

(58) Field of Classification Search ..... 137/615, 137/801; 285/272, 354, 386–388
See application file for complete search history.

(56) References Cited

U.S. PATENT DOCUMENTS 1,985,012 A * 12/1934 Boehm ..... 285/190
5,715,868 A * 2/1998 Ching et al. ..... 137/801
6,328,067 B1 * 12/2001 Hsiung ..... 137/615

* cited by examiner

*Primary Examiner*—Kevin L Lee
(74) *Attorney, Agent, or Firm*—Troxell Law Office, PLLC

(57) ABSTRACT

An improved rotating spout lock joint sleeve comprised of a spout and a mounting sleeve at its bottom section, which is first inserted into a water supply base, with a lock joint sleeve pre-fitted onto the body of the spout utilized to form a continuum between its bottom section internal threads and the external threads at the top section of the water supply base, the features of which include the following. The opening of the lock joint sleeve is sufficiently enlarged to accommodate the insertion of the mouth at the anterior extremity of the spout, thereby enabling continuity between the bottom section of the spout and the mounting sleeve top edge. A stepped neck is crimped onto the lower section of the mounting sleeve such that when a mounting ring is placed against its lower extent, the mounting ring is at the same time against the bottom edge of the stepped section at the middle section inside the lock joint sleeve, enabling the initial coupling of the lock joint sleeve to the mounting sleeve outer circumference as well as the convenient and rapid fastening to the external threads at the top section of the water supply base. As such, the structure of the present invention provides for the secure assembly of the spout to the mounting sleeve, thereby achieving convenient fabrication, assembly, and installation that averts dislodging and prevents the abrasion of the spout surface.

1 Claim, 5 Drawing Sheets

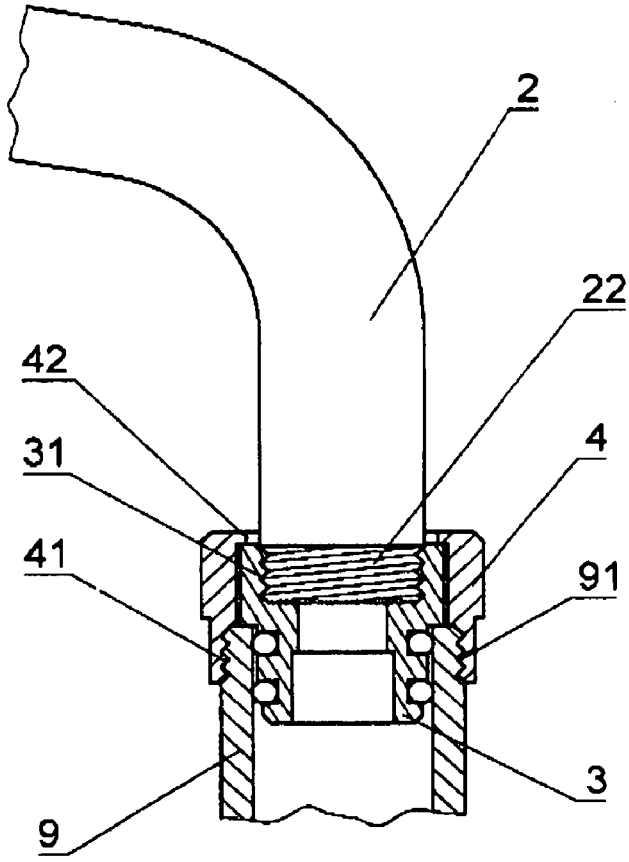
Fig. 1-A (Prior Art)

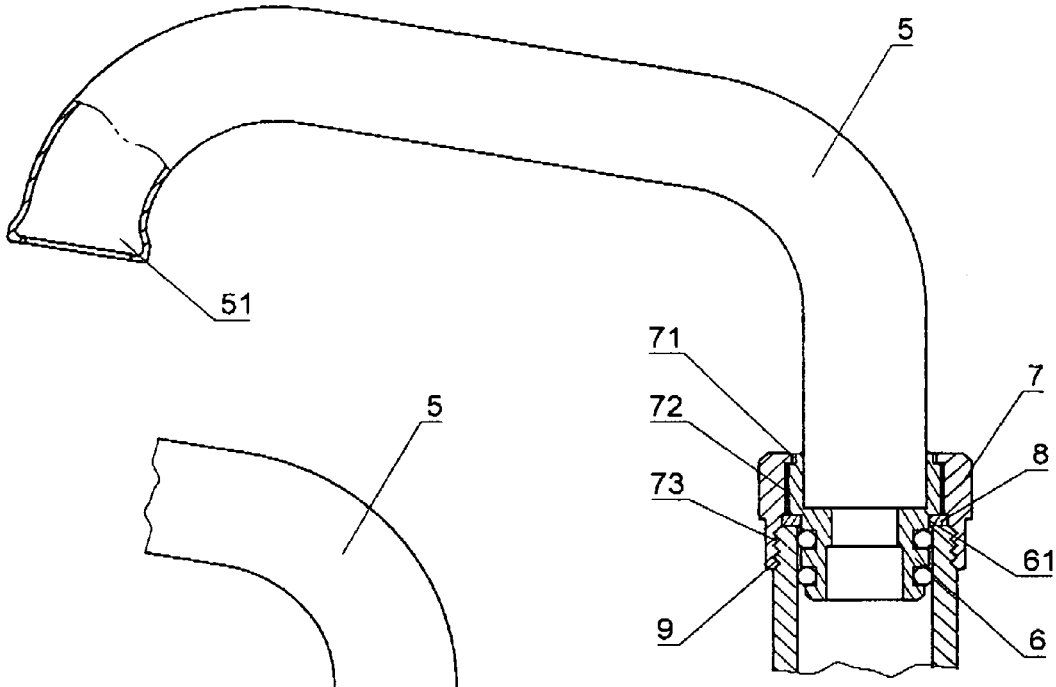
Fig. 3-A
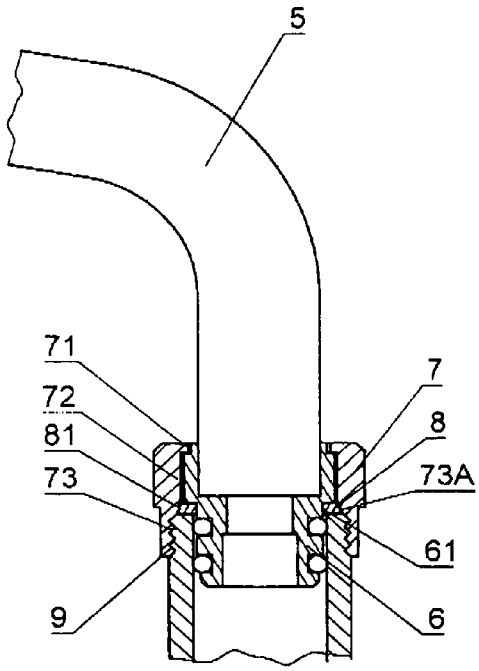
Fig. 3-B

ROTATING SPOUT LOCK JOINT SLEEVE

BACKGROUND OF THE INVENTION

1) Field of the Invention

The invention herein relates to an improved rotating spout lock joint sleeve that addresses the fixed installation of the spout to the bottom section mounting sleeve and in which the opening of the lock joint sleeve is sufficiently enlarged to accommodate the insertion of the mouth at the front end of the spout and a stepped neck is crimped onto the lower section of the mounting sleeve. When a mounting ring is placed against its lower extent of the stepped neck, the mounting ring is at the same time against the bottom edge of the stepped section along the middle section inside the lock joint sleeve, thereby coupling the lock joint sleeve to the mounting sleeve outer circumference such that dislodging and sliding are prevented.

2) Description of the Prior Art

Conventional water faucets that provide for moving the water output position typically utilize a rotatable spout, the structure (as indicated in FIG. 1 and FIG. 1-A) comprised of a spout 2 and a mounting sleeve 3 at its bottom section, which is first inserted into a water supply base 9, with a lock joint sleeve 4 pre-fitted onto the body of the spout 2 utilized to form a continuum between its bottom section internal threads 41 and the external threads 91 at the top section of the water supply base 9, enabling water to flow from the spout 2, which can be adjustably turned to control the water output position in a convenient operation.

However, in the lock joint structure that maintains the spout 2 on the water supply base 9, since the mouth 21 at the anterior extremity of the spout 2 is equipped with a front-end water filter, the interior of the joint lock sleeve 4 mouth 42 must be enlarged by machining; additionally, the spout 2 bottom section mounting sleeve 3 outer circumference is larger than the inner circumference of the joint lock sleeve 4 mouth 42; as such, the joint lock sleeve 4 cannot be fitted on after the mounting sleeve 3 is fastened to the spout 2 bottom section; the mounting sleeve 3 and the spout 2 each require surface treatment (such as electroplating) before the joint lock sleeve 4 is fitted onto the spout 2 body; following which the external threads 22 died along the bottom edge of the spout 2 are fastened to the internal threads 31 of the mounting sleeve 3 top section to complete conjoinment, utilizing an oxygen-free adhesive (welding into position is not possible after electroplating) to reinforce conjoinment strength; however, these assembly and installation tasks, in addition to the respective machining of the mounting sleeve 3 and the spout 2 as well as the inconvenience of time-consuming electroplating, the spout 2 body must be inserted loosely into the joint lock sleeve 4, which easily slides and moves during assembly, installation, or movement, resulting in rubbing and scratching damage to surface of the spout 2 body; furthermore, the bonding durability of the oxygen-free adhesive is adversely affected following a certain period of use and is especially susceptible to heat and moisture which easily lowers adhesion strength such that rotating the spout 2 causes the utilization drawback of mounting sleeve 3 loosening and dislodging.

SUMMARY OF THE INVENTION

The primary objective of the invention herein is to provide an improved rotating spout lock joint sleeve in which a stepped neck is crimped onto the lower section of a mounting sleeve such that when a mounting ring is placed against the lower extent of the stepped neck, the mounting ring is at the same time against the bottom edge of the stepped section at the middle section inside the lock joint sleeve; as such, the structure of the present invention provides for the secure assembly of the spout to the mounting sleeve, enabling the lock joint sleeve to be fitted over the mouth at the front section of the spout and then pushed against the mounting rings at the upper extent and lower extent of the mounting ring to complete conjoinment, with the mounting sleeve and the spout conveniently machined and electroplated after conjoinment to thereby reduce production time and cost for a significant economic advantage, which is among the features of the present invention.

Another objective of the invention herein is to provide an improved rotating spout lock joint sleeve, wherein the spout and the mounting sleeve are assembled together without reliance on a threaded union, but only on fitting and welding, following which they both undergo a surface treatment (such as electroplating); this procedure not only greatly shortens the fabrication process, but also eliminates the adverse effects on the conjoinment of the spout and the mounting sleeve attributed to prolonged usage, heat, or moisture on, thereby ensuring that the spout cannot be loosened at of dislodged from the mounting sleeve and effectively increasing structural durability, which is also among the features of the present invention.

Yet another objective of the invention herein is to provide an improved rotating spout lock joint sleeve, wherein a stepped neck is crimped onto the mounting sleeve lower section such that when a mounting ring is placed against its lower extent, the mounting ring is at the same time against the bottom edge of the stepped section at the middle section inside the lock joint sleeve, thereby coupling the lock joint sleeve to the outer circumference of the mounting sleeve; or, the external threads died on the mounting ring outer circumference are fastened to the internal threads section along the inner circumference of the lock joint sleeve to couple the lock joint sleeve to the outer circumference of the mounting ring; as such, the lock joint sleeve does not cause superficial abrasion or scratch damage when the spout is rotated, thereby effectively protecting the spout, which is also among the features of the present invention.

Still another objective of the invention herein is to provide an improved rotating spout lock joint sleeve, wherein the inner circumference of the mounting rings 8 can be varied to accommodate different specification mounting sleeves and spouts but remains similarly capable of the said conjoinment, assembly, and installation objectives, thereby economically and conveniently achieving a broad scope of application, which is also among the features of the present invention.

BRIEF DESCRIPTION OF THE DRAWINGS

FIG. 1-A is a cross-sectional drawing of the prior art.

FIG. 3-A is a cross-sectional drawing of the first structural embodiment of the invention herein.

FIG. 3-B is a cross-sectional drawing of second structural embodiment of the invention herein.

DETAILED DESCRIPTION OF THE PREFERRED EMBODIMENTS

Figure 1:
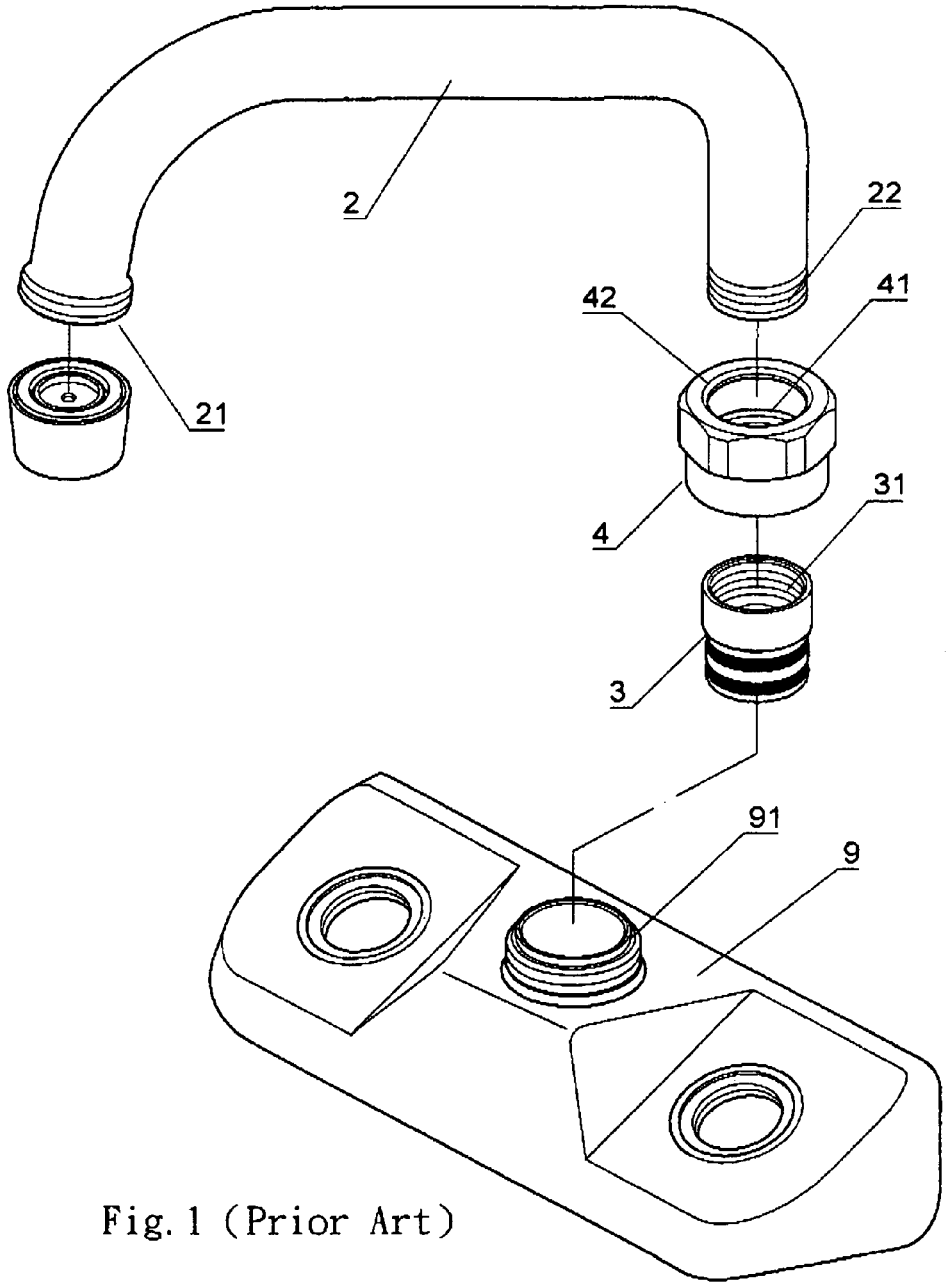
Fig. 1 (Prior Art)
FIG. 1 is an exploded drawing of the prior art.
Figure 2:
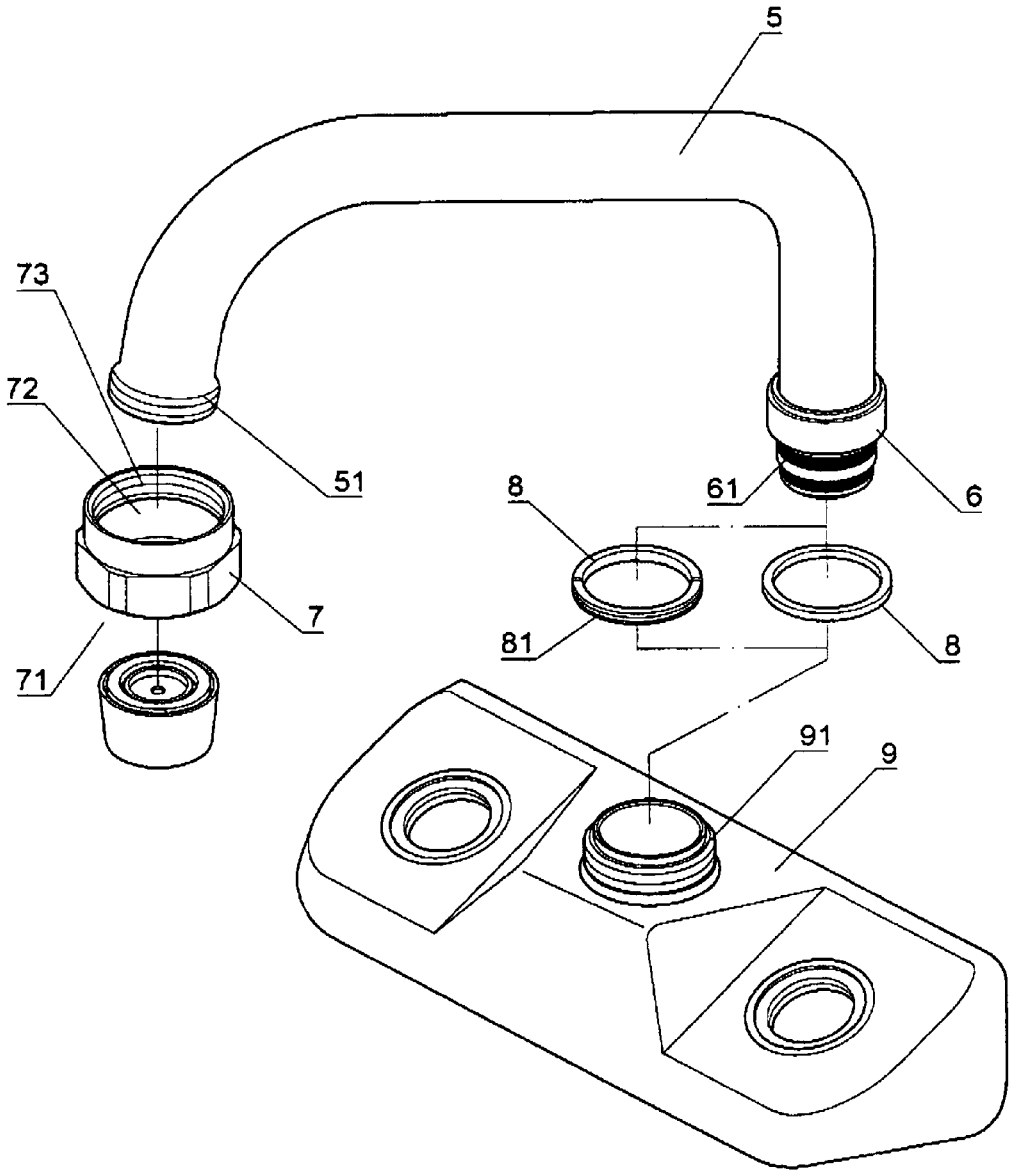
FIG. 2 is an exploded drawing of the invention herein.
Figure 3:
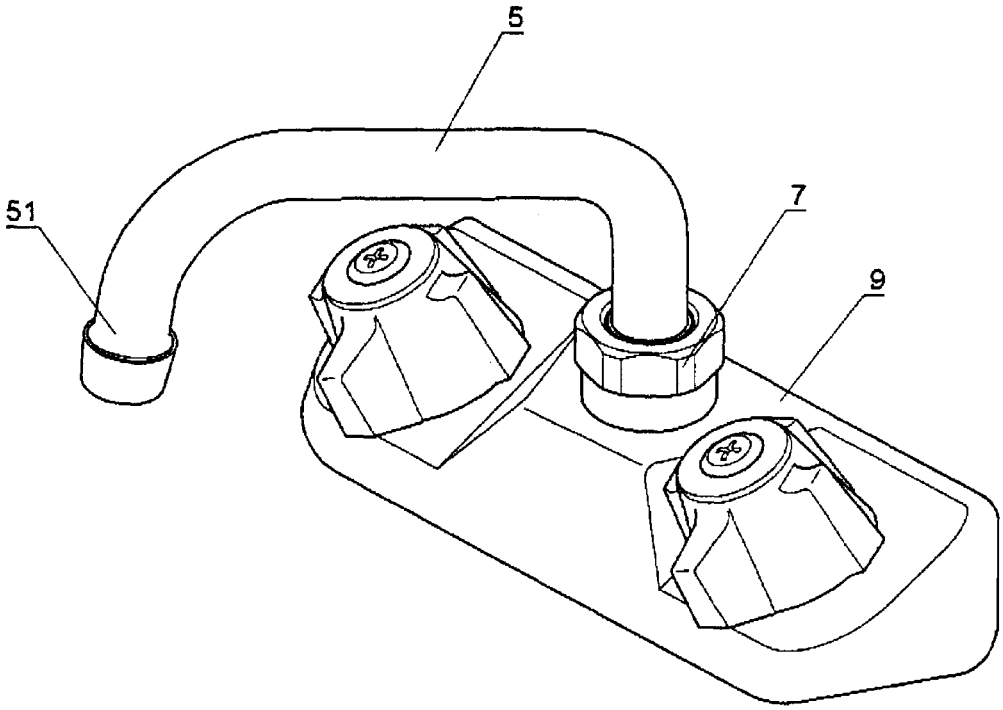
FIG. 3 is an isometric drawing of the invention herein.

As for the structural embodiments and utilization of the present invention, as indicated in FIG. 2, FIG. 3 and FIG. 3-A, the invention herein is comprised of a spout 5 and a mounting sleeve 6 at its bottom section, which is first inserted into a water supply base 9, with a lock joint sleeve 7 pre-fitted onto the body of the spout utilized to form a continuum between its bottom section internal threads 73 and the external threads 91 along the top section of the water supply base 9, the features of which are:

The spout 5 and the mounting sleeve 6 are fitted together and welded, completing the preliminary assembly, wherein a stepped neck 61 is next crimped onto the mounting sleeve 6 lower section and, as such, when a mounting ring 8 is placed against the stepped neck 61, the outer circumference of the mounting ring 8 exceeds the outer circumference protruding from the upper section of the mounting sleeve 6.

Additionally, the lock joint sleeve 7 opening 71 is sufficiently enlarged to accommodate the insertion of the mouth 51 at the anterior extremity of the spout 5, enabling the output of water from the mouth 51 at the anterior extremity of the spout 5 after the said lock joint sleeve 7 is fastened, thereby establishing continuity between the bottom section of the spout 5 and the mounting sleeve 6 top edge; a mounting ring 8 is situated against the outer circumference protruding from the middle section of the mounting sleeve 6 and, at the same time, against the bottom edge of the stepped section 72 at the middle section inside the lock joint sleeve 7; as such, the lock joint sleeve 7 is initially coupled to the mounting sleeve 6 outer circumference such that dislodging or forward movement is prevented; and the internal threads 73 along the bottom section of the coupled lock joint sleeve 7 are entirely fastened to the external threads 91 along the top section of the water supply base 9.

As a result, the said structure achieves convenient fabrication, assembly, and installation in that the conjoinment of the spout 5 to the mounting sleeve 6 fully protects against the dislodging of the spout 5, precludes surface abrasion, and other functions.

Referring to FIG. 2, FIG. 3, and FIG. 3-B, an internal threaded section 73A is additionally tapped to support the mounting ring 8 inserted and positioned against the bottom edge of the stepped section 72 at the middle section inside the lock joint sleeve 7 as well as augment the external threads 81 died on the mounting ring 8 outer circumference, enabling the mounting ring 8 to be fully fastened within the inner circumference of the lock joint sleeve 7, thereby effectively coupling the lock joint sleeve 7 to the outer circumference of the mounting sleeve 6.

What is claimed is:

1. A rotating spout lock joint sleeve assembly comprising:

a spout having a body between a mouth at an anterior extremity and a mounting sleeve attached to a posterior section of the spout, the mounting sleeve being configured to be inserted into a water supply base;

a lock joint sleeve pre-fitted onto the body of the spout, the lock joint sleeve being configured to form a continuum between internal threads at a bottom section of the lock joint sleeve and external threads along a top section of the water supply base;

a stepped neck attached to a lower section of the mounting sleeve;

a mounting ring configured to be positioned against both an outer circumference protruding from a middle section of the mounting sleeve and against a bottom edge of a stepped section inside the lock joint sleeve, wherein an outer circumference of the mounting ring exceeds an outer circumference protruding from an upper section of the mounting sleeve, the lock joint sleeve having an opening large enough to accommodate the insertion of the mouth at the anterior extremity of the spout to enable the output of water from the mouth after the lock joint sleeve is fastened to a top section of the water supply base, wherein the internal threads along the bottom section of the lock joint sleeve are configured to be fastened to the external threads along the top section of the water supply base, wherein the internal threads of the lock joint sleeve are tapped to support the mounting ring, when the mounting ring is inserted and positioned against the bottom edge of the stepped section at the middle section inside the lock joint sleeve, the internal threads of the lock joint sleeve have an internal threaded section threadedly connected to external threads located on the outer circumference of the mounting ring to enable the mounting ring to be fully fastened within an inner circumference of the lock joint sleeve thereby effectively coupling the lock joint sleeve to the outer circumference of the mounting sleeve.

* * * * *